US007401439B2

(12) United States Patent
Heroux

(10) Patent No.: US 7,401,439 B2
(45) Date of Patent: Jul. 22, 2008

(54) ADJUSTABLE DRAFT EXCLUDER

(75) Inventor: Steve G. Heroux, South Burlington, VT (US)

(73) Assignee: HIP Innovations, LLC, Williston, VT (US)

( * ) Notice: Subject to any disclaimer, the term of this patent is extended or adjusted under 35 U.S.C. 154(b) by 0 days.

(21) Appl. No.: 11/202,026

(22) Filed: Aug. 12, 2005

(65) Prior Publication Data

US 2006/0032144 A1 Feb. 16, 2006

Related U.S. Application Data

(60) Provisional application No. 60/601,328, filed on Aug. 13, 2004.

(51) Int. Cl.
*E06B 1/70* (2006.01)

(52) U.S. Cl. ..... 49/470; 49/482.1; 49/498.1; 277/921

(58) Field of Classification Search ..... 49/470, 49/475.1, 482.1, 484.1, 467, 495.1, 498.1; 277/906, 921, 650
See application file for complete search history.

(56) References Cited

U.S. PATENT DOCUMENTS

| | | | | |
|---|---|---|---|---|
| 370,207 | A * | 9/1887 | Negroponte | 49/482.1 |
| 604,301 | A | 5/1898 | Clabaugh | |
| 767,615 | A | 8/1904 | Webber | |
| 1,783,305 | A * | 12/1930 | Olson | 49/482.1 |
| 2,934,802 | A * | 5/1960 | Shekter | 49/493.1 |
| 4,765,094 | A | 8/1988 | Gemmell | |
| 4,959,927 | A | 10/1990 | Atkinson | |
| 5,475,948 | A | 12/1995 | Parke | |
| 6,332,294 | B1 | 12/2001 | Carranza | |
| 6,405,488 | B1 | 6/2002 | Brown | |
| 6,560,932 | B2 | 5/2003 | Heroux | |

FOREIGN PATENT DOCUMENTS

| | | | |
|---|---|---|---|
| GB | 2238069 | A | 5/1991 |
| GB | 2294282 | A | 4/1996 |

* cited by examiner

*Primary Examiner*—Gregory J. Strimbu
(74) *Attorney, Agent, or Firm*—Bacon & Thomas, PLLC

(57) ABSTRACT

An adjustable draft excluder includes at least a first draft blocking body for sealing a gap between architectural members such as a bottom of a door, window, or the like, and an adjacent surface. The draft blocking body includes an elongated sleeve having first and second ends, a lengthwise adjustable support assembly disposed within the sleeve and extending between the first and second ends of the sleeve, and an insulating material contained within the sleeve, whereby the draft blocking body is lengthwise adjustable. Alternatively, the sleeve comprises two halves slidably engaged such that the sleeve length is adjustable. A retaining member may be attached to the draft blocking body to attach the draft blocking body to the architectural member, such that the adjustable draft excluder moves with the architectural member. The retaining member may be a second draft blocking body similar to the first draft blocking body.

15 Claims, 5 Drawing Sheets

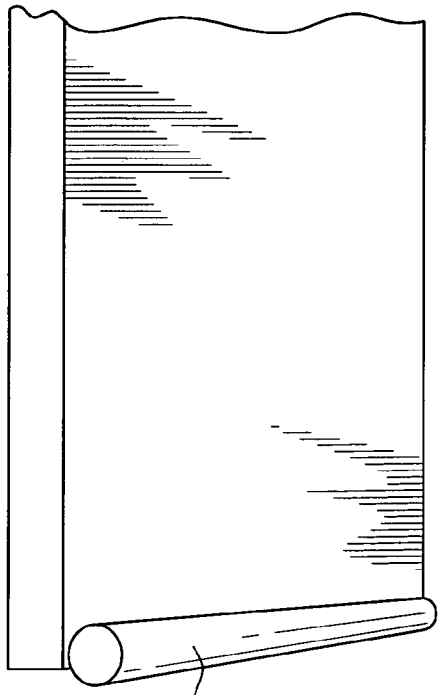
FIG. 2
FIG. 3a
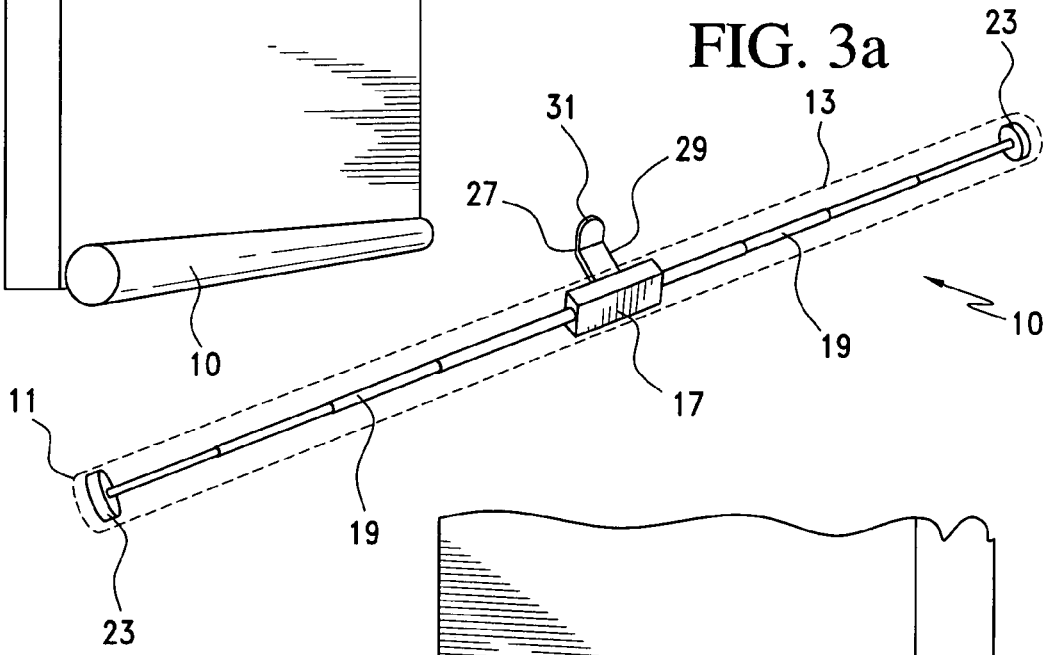
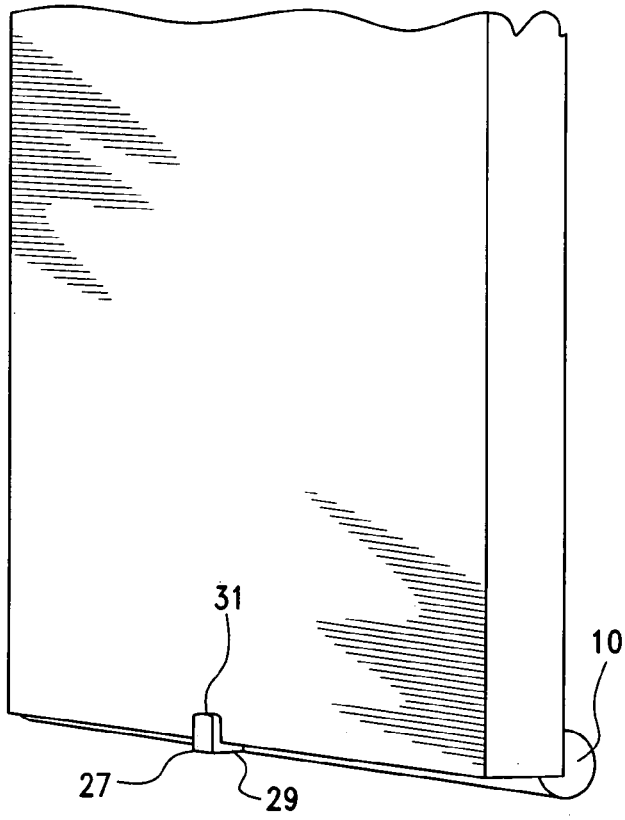
FIG. 3b

ADJUSTABLE DRAFT EXCLUDER

CROSS-REFERENCE TO RELATED APPLICATION

This application claims the benefit of U.S. Provisional Patent Application Ser. No. 60/601,328, filed Aug. 13, 2004.

FIELD OF THE INVENTION

The present invention relates to a draft sealing device, and more particularly to an adjustable draft excluder for sealing a gap between a movable architectural member and an architectural structure, such as a gap between a door and an underlying floor, to prevent drafts.

BACKGROUND

Numerous devices have been devised to seal gaps in an architectural structure, such as threshold seals or draft excluders that block a gap between a movable architectural member such as a door, window, or the like, and an underlying or adjacent architectural structure such as a floor, window sill, or the like.

Various embodiments of draft excluders may be permanently installed, or temporarily positioned, to stop drafts from flowing through the gaps. In a permanent installation, a rubber or cloth weather stripping seal may be secured, using nails, screws, or other fastening methods that render the installation permanent, to the bottom edge of a door, and positioned so that an edge of the seal contacts the underlying floor to seal the gap between the bottom of the door and the floor.

Other devices are adapted for temporary placement. Exemplary are draft excluders generally in the form of an elongated bean-bag or the like that may be placed on a floor alongside and contacting the bottom edge of a door, thereby blocking a gap between the bottom of the door and the floor.

These temporarily placed draft excluders are advantageous in that they are relatively easy to retrofit in an architectural structure, and may be readily removed from one placement and relocated to other positions throughout the architectural structure. However, these devices are generally of a fixed length, or require a permanent physical adjustment in length for adaptation to a placement of a particular width. Thus, such a draft excluder that is fitted to a door or window of a given width may not be, and may not be able to be made to be, compatible with another door, window, or other architectural member, of a different width.

SUMMARY

The adjustable draft excluder serves to block drafts in gaps between architectural members of an architectural structure, such as a gap between a bottom edge or surface of a door and an underlying floor, or a gap between an edge or surface of a window and an adjacent sill or frame member, or the like.

The adjustable draft excluder employs at least one elongated draft blocking body that is adjustable in length. The draft blocking body is adapted for placement to block a gap in an architectural structure, such as by placement alongside a gap between a bottom edge of a door and an underlying floor, or along a gap between a movable sash and a fixed sash or sill of a window.

In certain embodiments, at least one retaining member is attached to the draft blocking body to hold the draft blocking body in place against an adjacent architectural member such as a window or door. In such embodiments, the draft blocking body moves with the architectural member, such as moving along a floor with the bottom of a door as the door is opened and closed.

In other embodiments, the adjustable draft excluder employs two of the draft blocking bodies, joined together by at least one connector. The draft blocking bodies are spaced apart and substantially parallel, so that the adjustable draft excluder may be positioned with each of the draft blocking bodies on opposite sides of a door, with the connector(s) connecting the draft blocking bodies underneath the door. In this manner, a separate retaining member is not needed and the draft blocking effect may be doubled.

These and other features, aspects, and advantages of the present invention will become better understood with regard to the following description, appended claims, and accompanying drawings.

BRIEF DESCRIPTION OF THE DRAWINGS

FIG. 2 is a perspective view of an adjustable draft excluder positioned for sealing a gap at the bottom of the door.

FIG. 3*a* is a perspective view of an adjustable draft excluder having a retainer for retaining the adjustable draft excluder to a movable architectural member.

FIG. 3*b* is a perspective view of the adjustable draft excluder shown in FIG. 2*a*, showing the adjustable draft excluder retained against an architectural member in position for sealing a gap between the architectural member and an architectural structure.

DETAILED DESCRIPTION OF VARIOUS EMBODIMENTS

The present invention is an adjustable draft excluder. The adjustable draft excluder serves to block drafts through gaps between architectural members of an architectural structure, such as a gap between a bottom edge or surface of a door and an underlying floor, or a gap between an edge or surface of a window and an adjacent sill or frame member, or the like. The adjustable draft excluder is adjustable in length for use with multiple doors or windows of various widths without requiring permanent modification to fit any single width.

Figure 1A:
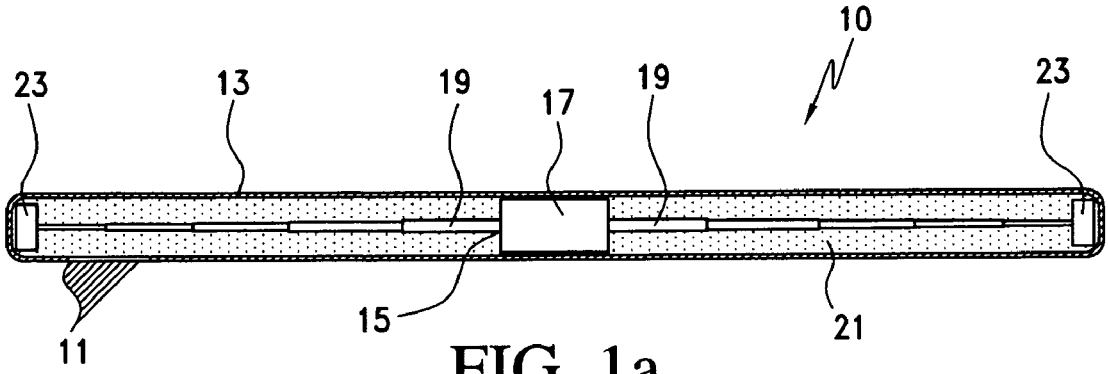
FIG. 1*a* is a section view of an embodiment of an adjustable draft excluder according to the present invention having a single lengthwise adjustable draft blocking body.

Turning to FIG. 1*a*, an embodiment of an adjustable draft excluder 10 is shown. The adjustable draft excluder 10 comprises an elongated draft blocking body 11 that is adjustable in length. The draft blocking body 11 has an outer sleeve 13 that is a roughly cylindrical or tubular cover or shell formed of a pliable material such as fabric, plastic, rubber, or the like. Disposed within, and extending from end to end of, the outer sleeve 13, is a lengthwise adjustable support assembly 15 comprised of a base portion 17, and a pair of telescoping, or lengthwise adjustable, arms 19 extending from opposite ends of the base portion 17. The telescoping arms 19 may be extended or contracted to fix the length of the adjustable draft excluder 10 to match the width of the door, window, or other gap to be sealed. The base portion 17 may be in any shape and made of any material which can firmly hold the telescoping arms 19.

The telescoping arms 19 may be substituted with alternative lengthwise adjustable structures, such as an accordion arm or scissor arm structure. Additionally, while the lengthwise adjustable support assembly 15 is illustrated within the draft blocking body 11, the draft blocking body 11 could be alternatively arranged to include an externally positioned mechanism for adjusting the length, such as a telescoping arm 19 disposed alongside an external surface and extending from end to end of the draft blocking body 11.

The outer sleeve 13 may be loosely filled with an insulating material 21 that increases the resistance of the draft blocking body 11 to the passing through of a draft. Numerous types of materials may be used as an insulating material 21 within the outer sleeve, including, but not limited to, foam rubber, particulate polystyrene foam, beans, sand, fibrous materials, and the like. The insulating material 21 is preferably compressible, or the outer sleeve 13 only partially filled, such that insulating material 21 doesn't hinder the lengthwise adjustment of the draft blocking body 11.

End caps 23 may be fixed to the ends of the telescoping arms 19. In operating an adjustable draft excluder 10 to adjust its length, a user may grasp the end caps 23 to manipulate the telescoping arms 19. Additionally, the end caps 23 provide support for the ends of the outer sleeve 13. The end caps 23 can be of any shape and made of any firm material including, but not limited to, wood, metal, or plastic. Additionally, the end caps 23 may be eliminated without compromising the functionality of the adjustable draft excluder 10.

In an alternative arrangement (not shown), the draft blocking body 11 may comprises the base portion 17 and a single telescoping arm 19 extended from one end of the base portion 17. In this arrangement, the base portion 17 is located at one end of the outer sleeve 13, and also functions as an end cap. The single telescoping arm 19 extends to the opposite end of the outer sleeve 13.

Figure 1B:
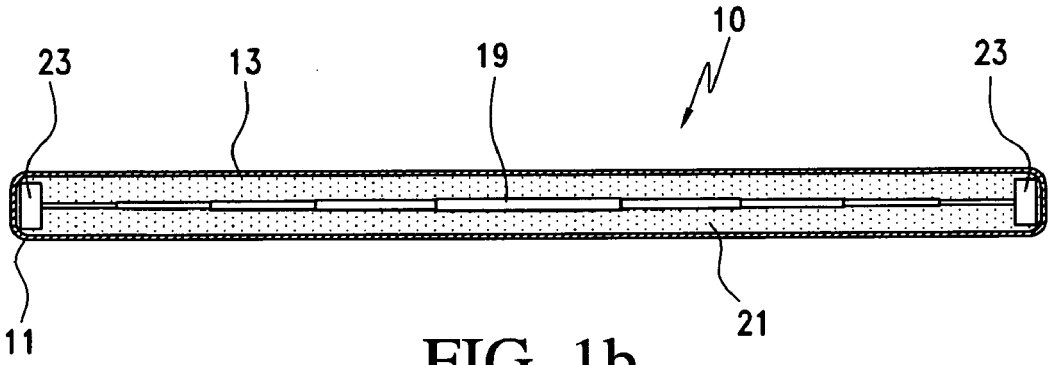
FIG. 1*b* is section view of a second embodiment of an adjustable draft excluder according to the present invention.

Referring to FIG. 1*b*, another embodiment of an adjustable draft excluder 10 is shown. Here, the draft blocking body 11 has a structure similar to the previously described embodiment except the base portion 17 is eliminated. The lengthwise adjustable support assembly 15 is a single telescoping arm 19 extending from end to end of the outer sleeve 13.

Figure 1C:
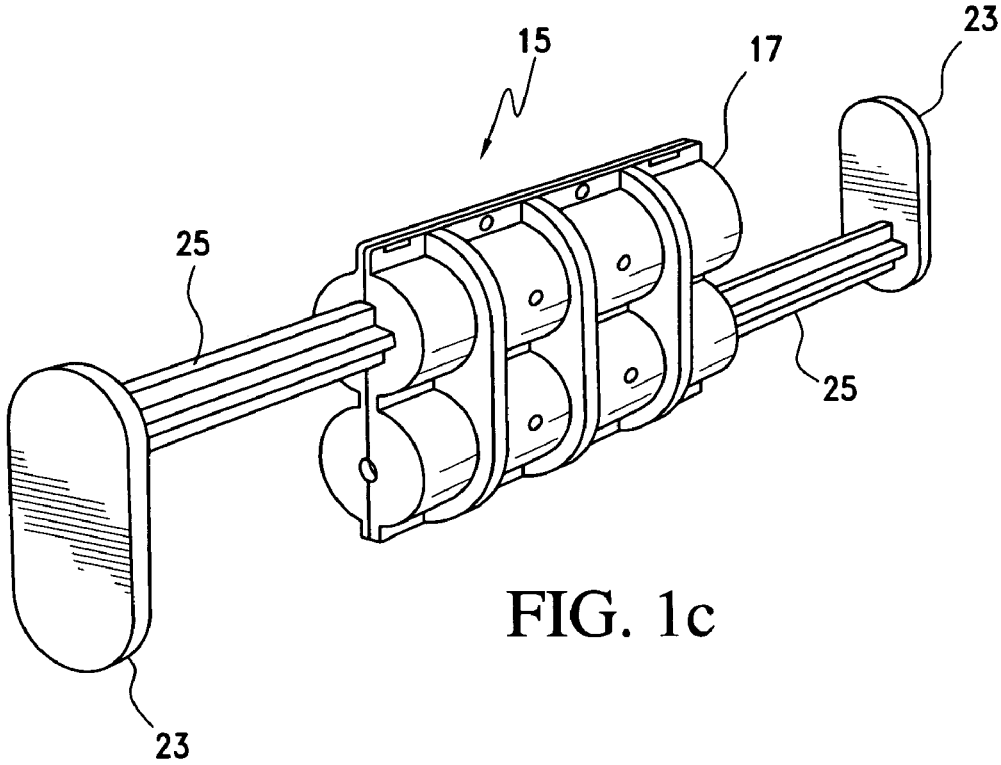
FIG. 1*c* is a perspective view of an alternative embodiment of a lengthwise adjustable support assembly for an adjustable draft excluder according to the present invention.

Turning now to FIG. 1*c*, an alternative embodiment of a lengthwise adjustable support assembly 15 is shown, wherein telescoping arms 19 of the previous embodiments are replaced with rigid arms 25 that are slidably engaged within a base portion 17. The arms 25 extend from opposite ends of the base portion 17, and are offset such that the arms 25 lie side-by-side when collapsed within the base portion 17 for compactness.

Turning now to FIG. 2, an adjustable draft excluder 10 may be solely comprised of a single draft blocking body 11. An adjustable draft excluder 10 of this embodiment may be simply placed to cover a gap, such as in the example shown wherein the adjustable draft excluder 10 is placed on a floor alongside a door to block a gap between the bottom edge of the door and the floor. It can be appreciated that the diameter of the draft blocking body 11 is related to the size of the gap to be blocked. In the example of a door, the draft blocking body 11 has a diameter at least greater than the distance between the bottom edge of the door and the floor. Stated more generally, the draft blocking body 11 has a diameter at least greater than the size of a gap to be blocked or sealed.

Turning now to FIGS. 3*a* and 3*b*, an embodiment of an adjustable draft excluder 10 is shown comprising a single draft blocking body 11 and a retainer 27 attached to the draft blocking body 11 to retain the adjustable draft excluder in position. In the example shown, the retainer 27 retains the draft blocking body 11 in place against the bottom edge of a door so that the adjustable draft excluder 10 moves in tandem with the door as the door is opened or closed. As shown in FIGS. 3*a* and 3*b*, the retainer 27 comprises a horizontal arm 29, which passes below the door, and an upright end portion 31. The horizontal arm 29 has a length that approximates the width of the architectural structure (door, window, etc) to which the adjustable draft excluder 10 will be attached.

Figure 4A:
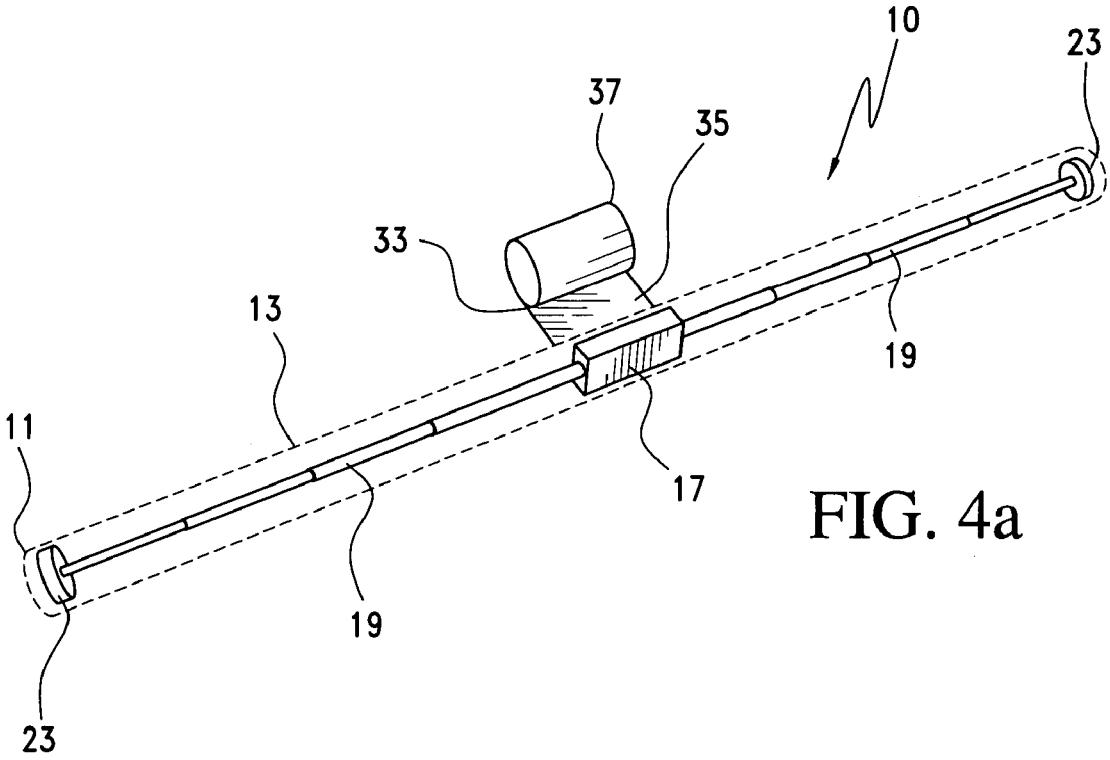
FIG. 4*a* is a perspective view of an adjustable draft excluder having an alternative device for retaining the adjustable draft excluder in position proximate to a movable architectural member.
Figure 4B:
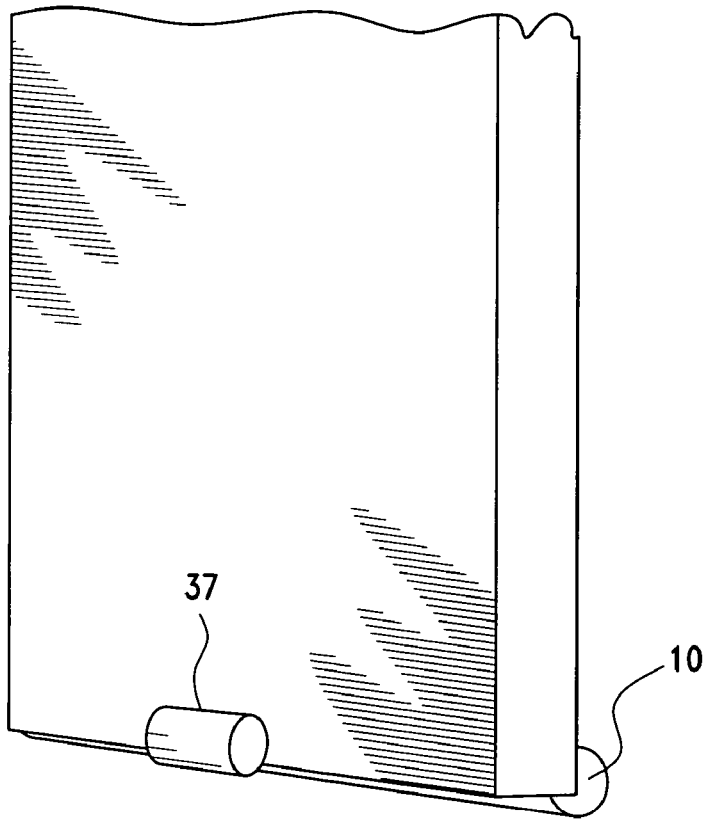
FIG. 4*b* is a perspective view of the adjustable draft excluder shown in FIG. 3*a*, showing the adjustable draft excluder retained against an architectural member in position for sealing a gap between the architectural member and an architectural structure.

Turning now to FIGS. 4*a* and 4*b*, an adjustable draft excluder 10 is shown comprising a single draft blocking body 11 and an alternative retainer 33. The alternative retainer 33 comprises at least one connector 35 that is attached at one end to the draft blocking body 11, and the other end to a retaining body 37 that is larger than the gap being blocked or sealed. In the illustrated example, the adjustable draft excluder 10 is retained against the bottom of a door by a retaining body 37 that is taller than the distance between the bottom edge of the door and the floor. The retaining body 37 shown is a short cylinder. However, the retaining body 37 may be of any shape, including decorative shapes or figures. The connector 35 may attach to the outer sleeve 13 of the draft blocking body 11, or to the lengthwise adjustable support assembly 15, passing through the outer sleeve 13. The connector 35 may be made from an elastic material so that the retaining body 37 and the draft blocking body 11 are pulled snugly together against opposite sides of the door. Additionally, the connector 35 may have a variable or adjustable length to be fitted to doors or windows of varied widths.

Figure 5A:
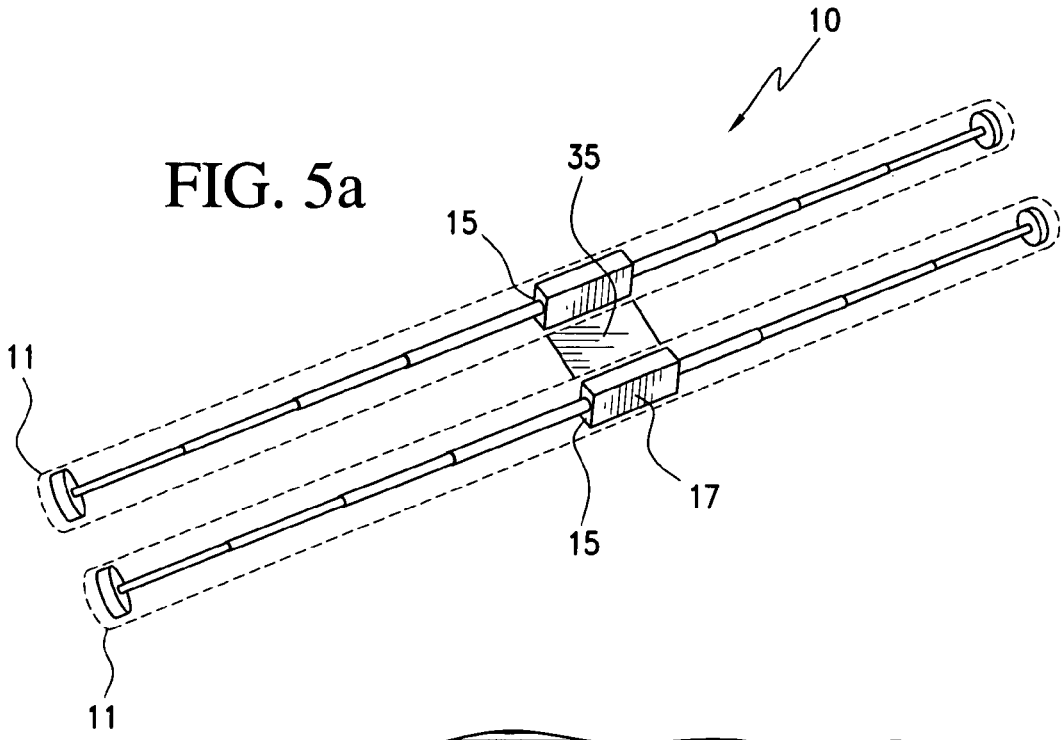
FIG. 5*a* is a perspective view of an adjustable draft excluder according to the present invention having a pair of lengthwise adjustable draft blocking bodies.
Figure 5B:
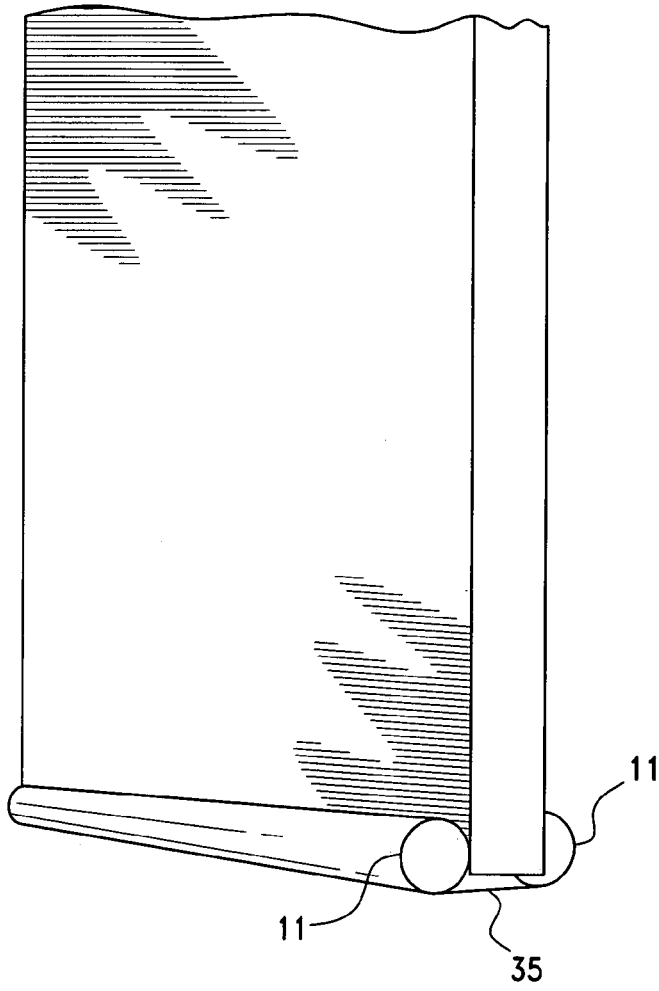
FIG. 5*b* is a perspective view of the adjustable draft excluder shown in FIG. 5*a*, showing the adjustable draft excluder positioned at a bottom edge of an architectural member.

Turning now to FIGS. 5*a* and 5*b*, an embodiment of an adjustable draft excluder 10 is shown comprising a pair of draft blocking bodies 11 joined together in a spaced apart and substantially parallel relationship by at least one connector 35. The at least one connector 35 may be connected between the base portions 17 or another part of the lengthwise adjustable support assemblies 15, of the joined draft blocking bodies 11. Alternatively, the at least one connector 35 may be connected between the outer sleeves of each of the draft blocking bodies 11. The at least one connector 35 may be made of a rigid or semi-rigid material such as wood, plastic, metal, or the like, or of a flexible and pliable material such as fabric.

Figure 6:
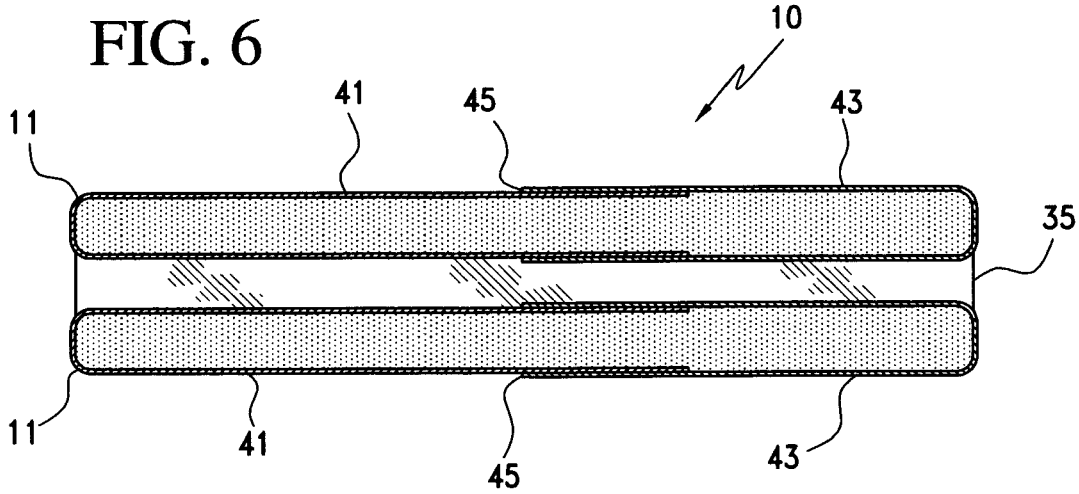
FIG. 6 is a sectional plan view of an alternative embodiment of an adjustable draft excluder according to the present invention.

Turning now to FIG. 6, an adjustable draft excluder 10 is shown wherein draft blocking bodies 11 are formed without an internal lengthwise adjustable support assembly. Instead, outer sleeves 13 are formed of a material that is at least semi-rigid. The outer sleeves 13 comprise first and second halves 41, 43 that are slidably, or telescopically, engaged with one another. In the illustrated embodiment, a first half 41 has an outside diameter or dimensions equal to, or slightly smaller than, the inside diameter or dimensions of a second half 43 such that the first half 41 may slide freely into an open end 45 of the second half 43, the first half 41 being telescopically received at least in part within the open end 45 of the second half 43. It can be recognized that, while the first and second halves 41, 43 illustrated have a round cross section, other shapes may be employed. Preferably, a close fit is established so that the first and second halves 41, 43 tend to retain their position once set, although alternative methods may be used to fix the length of the draft blocking bodies 11.

Such a draft blocking body 11 may be used singly, or with a retainer, as described above, or may be joined to a second draft blocking body 11 in a spaced apart and substantially parallel relationship by at least one connector 35, as illustrated. As shown in FIG. 6, the connector 35 is a single fabric strip disposed lengthwise between the draft blocking bodies 11, extending generally from end to end of the adjustable draft excluder 10. It can be recognized that, in order to accommodate the variable length of the adjustable draft excluder 10, the fabric strip may be made of an elastic material or attached intermittently to allow free movement of the first and second halves 41, 43 of the draft blocking bodies 11.

Figure 7:
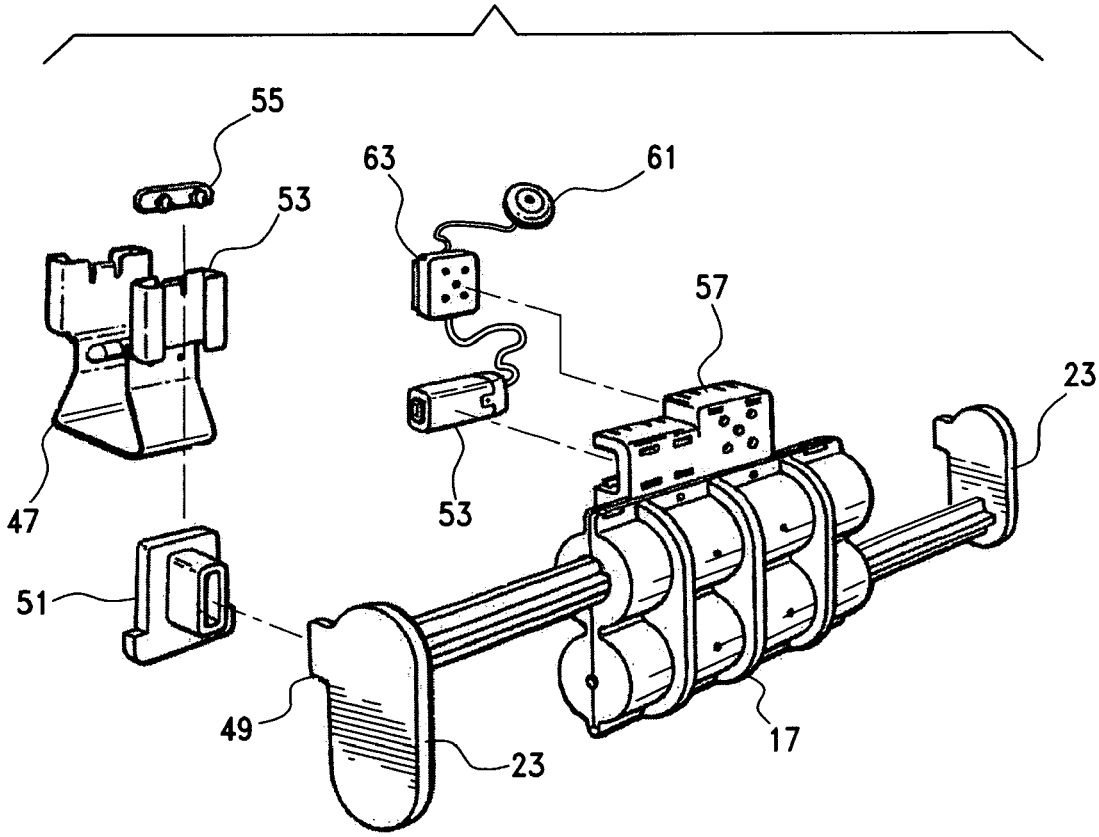
FIG. 7 is an exploded perspective view of an adjustable support assembly for an adjustable draft excluder according to the present invention including mounting clips for attaching the adjustable draft excluder to an architectural member.

Turning now to FIG. 7, a lengthwise adjustable support assembly 15 is shown with mounting clips 47 for attaching an adjustable draft excluder 10 to an architectural member. The mounting clips 47 are generally U shaped clips for friction attachment to the edge of an architectural member. In the illustrated embodiment, mounting tabs 49 are formed on the end caps 23 for mounting of bracket holders 51 through the outer sleeve 13. The mounting tabs 49 are essentially flat tab members adapted to slidably engage with slide-mount channels 53 formed on the mounting clips 47. It can be recognized that the mounting clips 47 may be oriented as shown, for attachment to the bottom edge of a door or the like, or inverted for attachment to a top edge of a window sash or the like. Pads 55 may be attached to the mounting clips 47 both to improve the grip of the mounting clips 47 and to protect against damage to the door, window, or other architectural member where the adjustable draft excluder 10 is used. The pads 55 may be made of rubber, fabric, plastic, or another suitable material for protecting and gripping an architectural member.

Also shown in FIG. 7 is a receptacle or housing 57 that may be attached to, or formed as a part of, the base portion 17 of the lengthwise adjustable support assembly 15, or disposed elsewhere within or on a part of the adjustable draft excluder 10. In the illustrated embodiment, electronic components are contained within the housing 57, including a battery 59, a motion sensor 61, and a speaker or sound transducer 63 forming a simple motion-sensing alarm circuit. Thus, an adjustable draft excluder 10 may function as a door or window alarm, sounding an alarm signal if the door or window is moved. Alternative to an alarm signal, a door-chime or other sound may be produced.

It will be understood that the above-described embodiments of the invention are illustrative in nature, and that modifications thereof may occur to those skilled in the art. Accordingly, this invention is not to be regarded as limited to the embodiments disclosed herein, but is to be limited only as defined in the appended claims.

I claim:

1. An adjustable draft excluder for excluding drafts by sealing a gap between a movable architectural member and an architectural structure, the draft excluder comprising:

at least one lengthwise adjustable draft blocking body having a generally elongated configuration, the draft blocking body comprising an outer sleeve having first and second closed ends and an insulating material disposed within said outer sleeve said outer sleeve comprising a pliable material extending substantially continuously from said first end to said second end;

a lengthwise adjustable arrangement comprising a variable length adjusting mechanism disposed within and extending between the first and second ends of said outer sleeve, the lengthwise adjustable arrangement being arranged to enable variation and setting of the length of the draft blocking body and;

wherein said variable length adjusting mechanism comprises a base portion and comprises a pair of lengthwise adjustable arms respectively extendable from opposing ends of said base portion.

2. The adjustable draft excluder according to claim 1, further comprising at least one retaining member attached to said draft blocking body, the retaining member being adapted for retaining said draft blocking body proximate to said architectural member.

3. The adjustable draft excluder according to claim 2, wherein said retaining member has a joining portion and a retaining portion, the joining portion being connected to said draft blocking body and separating the retaining portion away from the draft blocking body by a distance substantially equal to a width of said movable architectural member.

4. The adjustable draft excluder according to claim 2, wherein said retaining member comprises a second lengthwise adjustable draft blocking body, and wherein a second lengthwise adjustable arrangement is disposed within said second draft blocking body.

5. The adjustable draft excluder according to claim 4, wherein said second lengthwise adjustable arrangement comprises a lengthwise adjustable arm.

6. The adjustable draft excluder according to claim 4, wherein said second lengthwise adjustable arrangement comprises a second base portion and a third lengthwise adjustable arm extendable from said second base portion.

7. The adjustable draft excluder according to claim 6, wherein said third lengthwise adjustable arm comprises a pair of lengthwise adjustable arms respectively extendable from opposing ends of said second base portion.

8. The adjustable draft excluder according to claim 6, further comprising a cap disposed on an end of each said lengthwise adjustable arm.

9. The adjustable draft excluder according to claim 4, wherein the ends of said second draft blocking body are closed.

10. The adjustable draft excluder according to claim 1, further comprising a cap disposed on an end of at least one of said lengthwise adjustable arms.

11. An adjustable draft excluder for excluding drafts by sealing a gap between a movable architectural member and an architectural structure, the draft excluder comprising:

at least one lengthwise adjustable draft blocking body having a generally elongated configuration, the draft blocking body comprising an outer sleeve having first and second closed ends said outer sleeve comprising a pliable material extending substantially continuously from said first end to said second end; and a lengthwise adjustable arrangement comprising a variable length adjusting mechanism disposed within and extending between the first and second ends of said outer sleeve, the lengthwise adjustable arrangement being arranged to enable variation and setting of the length of the draft blocking body; and wherein said variable length adjusting mechanism comprises a base portion and a pair of lengthwise adjustable arms respectively extendable from opposing ends of said base portion.

12. The adjustable draft excluder according to claim 11, further comprising at least one retaining member attached to said draft blocking body, the retaining member being adapted for retaining said draft blocking body proximate to said architectural member.

13. The adjustable draft excluder according to claim 12, wherein said retaining member has a joining portion and a retaining portion, the joining portion being connected to said draft blocking body and separating the retaining portion away from the draft blocking body by a distance substantially equal to a width of said movable architectural member.

14. The adjustable draft excluder according to claim 13, wherein said retaining portion comprises a second lengthwise adjustable draft blocking body, and wherein a second lengthwise adjustable arrangement is disposed within said second draft blocking body.

15. The adjustable draft excluder according to claim 11, further comprising a cap disposed on an end of at least one of said lengthwise adjustable arms.

* * * * *